United States Patent [19]

Reed et al.

[11] Patent Number: 5,042,403

[45] Date of Patent: Aug. 27, 1991

[54] ENVIRONMENTALLY SAFE PROCESS FOR THE DISPOSAL OF ELECTRICAL EQUIPMENT

[75] Inventors: Keith R. Reed, Raleigh; Kenneth G. Zion, Mathews, both of N.C.

[73] Assignee: Environmental Protection Services, Wheeling, W. Va.

[21] Appl. No.: 588,882

[22] Filed: Sep. 27, 1990

[51] Int. Cl.[5] ..... F23G 5/00

[52] U.S. Cl. ..... 110/346; 110/236; 134/19

[58] Field of Search ..... 110/236, 346, 237; 134/19, 20

[56] References Cited

U.S. PATENT DOCUMENTS 3,320,051 5/1967 Lieberman ..... 110/236 X 3,448,702 6/1969 McLouth ..... 110/236

3,693,951 9/1972 Lawhon et al. ..... 110/236 X 4,759,298 7/1988 Koptis et al. ..... 110/236 X

OTHER PUBLICATIONS

"Smokeless Burn-Off of Insulation from Copper Coil Rejects"; *Metals and Materials*; vol. 7, No. 10, 1973.

*Primary Examiner*—Edward G. Favors

*Attorney, Agent, or Firm*—Rothwell, Figg, Ernst & Kurz

[57] ABSTRACT

An environmentally safe process for the recycling of spent electrical equipment, such as electrical transformers, comprises placing intact equipment within a furnace and burning the combustible materials, including PCB-contaminated insulating oil. Following combustion, the equipment is cooled, disassembled, and the various metals and porcelain are recycled.

10 Claims, No Drawings

ENVIRONMENTALLY SAFE PROCESS FOR THE DISPOSAL OF ELECTRICAL EQUIPMENT

BACKGROUND OF THE INVENTION

The present invention relates to the processing of, and metals recovery from, used electrical equipment such as transformers. More particularly, the invention provides an environmentally safe process for the disposal and recycling of contaminated oil-containing electrical equipment by incinerating the equipment in intact form in order to destroy the oil and its contaminants, thus rendering the equipment suitable for metal recycling and recovery. Advantageously, the process is carried out without workers being exposed to the contaminated oil.

Each year, millions of pieces of electrical equipment become outmoded and must be discarded by power companies and other industries. One challenge facing the electrical equipment industry is the disposal of such equipment in a manner consistent with governmental regulations and, beyond the letter of the applicable regulations, sound environmental protection practices regarding the disposal of hazardous materials.

Electrical equipment such as transformers used throughout electric power supply systems are known to contain insulating (dielectric) oil, insulation and other combustible materials containing a variety of harmful substances such as polychlorinated biphenyls ("PCB's"), dioxin and furans. The harmful effects of PCB's and many other oil contaminants have been well documented in recent years, and government regulations address the disposal of such contaminant-laden oil.

A prior method employed for the de-commissioning and disposal of electrical transformers containing contaminated insulating oil starts with draining the oil from the transformer tank enclosure, followed by disassembly of the transformer and its components from the tank. The various components, which are manufactured from silicon steel, copper, aluminum, ceramic and possibly other materials are stacked in a furnace and burned. The tank enclosures, which continue to contain residual amounts of contaminated dielectric oil, are either rinsed with a solvent or filled with an absorbent material. The oil-laden solvent or absorbent then is discarded, frequently without regard for its harmful contents.

In addition to problems related to the disposal of the solvent or absorbent, the process suffers from the disadvantage that workers are exposed to the contaminated oil, insulation and other materials. Also, burning transformer coils which have been removed from their cases has resulted in an uncontrollable burn, with the final temperature reaching 1600° F. The uncontrollable burn caused a complete meltdown of the aluminum and produced a lake of melted aluminum on the furnace floor. Thus, this process would not be suited for the commercial processing and disposal of spent electrical equipment and metals recovery therefrom.

One object of the present invention is to provide an environmentally safe process for recycling spent electrical equipment which permits total destruction of contaminated combustible material from the equipment, and recycling of 100 percent of the non-combustible materials, thus totally eliminating the need for landfill or scrap yard storage of spent electrical equipment.

Another object of this invention is to provide such a process which employs only environmentally sound practices for the destruction of contaminant-containing insulating oil, insulation and other combustible materials, and avoids the use of chemicals, solvents, absorbents or other materials which themselves present disposal hazards.

A further object of this invention is to reduce potential financial liability of the electrical equipment owner by eliminating the possibility of contaminated oil-related health problems among its employees, the environment and the public at large.

SUMMARY OF THE INVENTION

The foregoing and other objects are attained by the present environmentally safe process for recycling electrical equipment, which process includes the step of heating the intact, oil-drained equipment to a temperature sufficient to ignite the combustible materials contained therein, for a period of time sufficient to burn the combustible materials, thereby destroying PCB's and other harmful materials. Following this heat treatment, the equipment can be further processed as desired without concern for the health risks associated with contaminated oil, which has been destroyed. Such further processing typically includes the steps of allowing the equipment to cool, disassembling the components, sorting the components by metal content and subjecting the various metals to metal recovery operations.

In preferred form the present process includes placing the intact equipment in the primary chamber of a multi-chamber closed furnace, the primary chamber being maintained initially at a temperature sufficient to ignite the combustible materials. Such combustion causes the equipment to reach a peak temperature, after which the furnace is held at a substantially constant temperature until combustion is essentially complete. The smoke and off-gasses from the furnace pass through an afterburner to complete combustion and render the gasses appropriate for release into the atmosphere without further treatment. The equipment is permitted to cool, and ash which usually forms during heating is removed from within the equipment. In particularly preferred versions of the process, the ash is removed by placing the equipment, inverted, upon a vibrating rack. Finally, the various metals are sorted and sent to appropriate recovery/reclamation facilities. The ash, too, can be subjected to metals recovery and needs not be disposed.

The present process addresses the disposal of electrical equipment following drainage of the contaminated insulating oil, wherein the oil contained less than 500 parts per million ("ppm") of PCB's. The transportation and disposal of such electrical equipment currently is not regulated by the U.S. Environmental Protection Agency per 40 C.F.R. § 761.60(b)(5)(B)(ii). Even though the disposal of such equipment is not regulated under current U.S. Environmental Protection Agency regulations, public concern and economic considerations dictate that environmental harm must not be allowed to occur by the escape of even the small volume of contaminant-containing oil which remains in the equipment following draining.

The present process possesses many advantages over the prior disposal method discussed above. Our process advantageously provides an alternative to present practices of disposal of such equipment in landfills and scrap yards, where the costs of disposal are rising and the escape of PCB's and other contaminants into the environment cannot be guaranteed against. Another benefit of our process is that workers are not exposed to the contaminated insulating oil, as the transformer cases are not opened prior to the destruction of the oil. Yet another advantage of our process is that the burn temperature is kept under control by virtue of each coil assembly being burned within its own transformer case. The coils do not melt, as seen previously, and thus can be recovered and recycled.

The process of this invention, in accordance with the foregoing objects and brief description is described in further detail below. The description of certain preferred embodiments is not intended to limit the scope of the invention, however.

DETAILED DESCRIPTION OF THE PREFERRED EMBODIMENTS

The present process is directed to the recycling of "non-regulated" electrical equipment which has been drained of the major portion of its PCB-containing insulating oil. Disposal of the insulating oil per se is governed by U.S. Environmental Protection Agency regulations and forms no part of the present invention.

The process is particularly directed to equipment containing insulating oil having less than 500 parts per million of PCB's. A sample of residual oil from within the equipment is tested to ensure the presence of less than 500 ppm PCB's.

The process in its preferred form begins with the placement of a unique identification number upon each piece of spent equipment. The identification number, along with pertinent information such as source, PCB levels and date acquired, is entered into a computerized tracking system which can be utilized to track each individual piece throughout the recovery process and provide a computerized record of its progress therethrough. In preferred form, the identification number is embodied in a bar code tag which can be read at various points within the process facility.

The drained equipment then is placed within the primary chamber of a multi-chambered closed furnace. While the construction of the furnace is not critical to the operation of the inventive process, we have found it advantageous to employ baskets driven by a motorized cart to carry the spent equipment into the furnace. The basket and cart then forms the floor of the furnace, and provides a convenient method for later removing the equipment from the furnace.

Once the furnace is loaded and sealed, the large natural gas burner is ignited and begins to heat the interior of the furnace. In a first portion of the heating operation, the temperature within the primary chamber is brought to a point at which the combustible materials within the equipment ignite. Typically, this is between about 525° to 575° F., and ignition occurs about 30 minutes into the heating cycle. Temperature within the furnace and the operation of the burner preferably are monitored and automated by a computer-assisted system monitoring various combustion parameters as known in the art.

The temperature of the primary chamber should not need to be augmented by the burner once ignition of the equipment occurs, as the temperature naturally rises depending upon the total quantity of combustibles present. The equipment reaches a final (peak) temperature of between about 900° and 1150° F. after a period of about 60 to 90 minutes. Shortly after the peak temperature is reached, signifying the destruction of the major portion of the combustible materials, the furnace temperature begins to drop. At that point, the burner is again ignited and regulated to hold the primary chamber at approximately 1000° F. until the remainder of the combustibles are burned, as determined by visual inspection of the equipment within the furnace.

Upon completion of the heating cycle, which generally takes a total of about 4 hours, the equipment is cooled. The furnace is opened, and the motorized cart containing the equipment is driven into a cool-down chamber. The cooling chamber provides a high volume of ambient air circulation, for example about 50,000 cubic feet per minute, which is passed over the equipment for about 4 hours in order to speed cooling. An additional cool-down period of about 24 hours is employed to bring the equipment back to room temperature. At this point, all combustible materials have been destroyed, along with PCB's, dioxin and other harmful contaminants. The equipment is now much safer to handle, and is in condition to be disassembled for subsequent metal and ceramic recovery.

Prior to disassembly, it is desirable to remove the ash which collects within the equipment during the heating cycle. A novel, convenient method for removing this ash includes placing the equipment, inverted, upon a shaker table for a period of about 8 to 10 minutes of constant vibration. The vibration forces the ash from the transformers and tanks where it passes into an enclosed ash-handling system which conveys it into a bulk sealed plastic container. The ash, which consists predominantly of metallic copper and copper oxides, is advantageously subjected to metal recovery to avoid disposal.

The electrical equipment then is disassembled by hand, and the various metals and porcelain are sorted for subsequent recovery. The core and coil assembly is removed from each piece of equipment; the oil- and contaminant-free case is compressed and shipped to a smelter; the copper winding is separated from the core, and the various metals are separated by type and shipped to smelters. At this point, only the bar code identification tag remains, providing evidence that the equipment has been dismantled. A certificate of processing is sent to the customer, signifying the completion of the recycling procedure.

Smoke and gasses from the primary chamber are routed through an afterburner to complete combustion and greatly reduce emissions. Suitable afterburners are known in the art; gasses pass into a retention chamber where they travel a circuitous route and are heated by a secondary burner located in the chamber. From the retention chamber, the gasses pass into a mixing chamber, are oxygenated with additional combustion air, and ultimately are cooled and exit into the atmosphere. Products of combustion are maintained at approximately 2200° F. for a minimum of 2 seconds and 3 percent excess oxygen. Combustion efficiency will be at least 99.9% as computed in 40 C.F.R. § 761.70(a)(2).

It is preferred to provide a number of automated fail-safe systems within the process system. Critical operating and safety parameters are constantly monitored to assure the safety and efficacy of the process.

While the present invention has been described in connection with various particularly preferred features, it is not so limited. Variations within the scope of the appended claims will be apparent to the skilled worker.

We claim:

1. An environmentally safe process for recycling intact electrical equipment which includes PCB containing oil, comprising heating the intact equipment to a temperature sufficient to ignite combustible materials therein for a period of time sufficient to combust substantially all of the combustible materials including the PCB-containing oil.

2. An environmentally safe process for recycling intact oil-containing electrical equipment comprising draining oil from the equipment, heating the intact equipment to a temperature of from about 900° to about 1150° F. for a period of time sufficient to combust the combustible materials therein, and separating components of the equipment based on their metal content.

3. A process according to claim 2 wherein the heating step comprises a first segment wherein the equipment is subjected to a temperature sufficient to ignite any combustible materials therein and permitted to attain a peak temperature, and a second segment wherein the equipment is subjected to a temperature about equal to the peak temperature for a time period sufficient to result in combustion of essentially all remaining combustible materials.

4. A process according to claim 3 wherein said peak temperature is between about 900° and about 1150° F.

5. A process according to claim 3 wherein the first segment has a duration of about 60 to about 90 minutes.

6. A process according to claim 2 further comprising the step of removing ash from the interior of the equipment subsequent to the heating step and prior to the separating step.

7. A process according to claim 6 wherein the ash removing step is carried out by placing the equipment, inverted, upon a vibrating platform.

8. A process according to claim 7 wherein the ash is collected into containers within an enclosed ash handling system.

9. An environmentally safe process for recycling intact oil-containing electrical equipment comprising:

a) placing intact, combustible material-containing electrical equipment into a furnace;

b) raising the temperature of the equipment sufficiently to ignite the combustible material;

c) allowing the equipment to reach a peak temperature of between about 900° and about 1150° F.;

d) cooling the equipment;

e) removing ash from within the equipment by placing the equipment, inverted, upon a vibrating table; and f) disassembling the equipment.

10. A process according to claim 9 wherein the equipment is held at a temperature of about 1000° F. until combustion is complete.

* * * * *